United States Patent [19]

Ward

[11] 4,069,860

[45] Jan. 24, 1978

[54] ABLATIVE BAND FOR A CASTING MACHINE

[75] Inventor: George C. Ward, Carrollton, Ga.

[73] Assignee: Southwire Company, Carrollton, Ga.

[21] Appl. No.: 634,382

[22] Filed: Nov. 24, 1975

[51] Int. Cl.[2] ..... B22D 11/06

[52] U.S. Cl. ..... 164/87; 164/268; 164/433

[58] Field of Search ..... 164/73, 87, 268, 278

[56] References Cited

U.S. PATENT DOCUMENTS

| | | | |
|---|---|---|---|
| 315,045 | 4/1885 | Lyman | 164/278 |
| 3,163,896 | 1/1965 | Rochester et al. | 164/73 |
| 3,343,590 | 9/1967 | Radd | 164/87 |
| 3,429,363 | 2/1969 | Hazelett et al. | 164/87 |
| 3,533,463 | 10/1970 | Hazelett et al. | 164/278 |
| 3,642,055 | 2/1972 | Nighman | 164/87 |
| 3,703,204 | 11/1972 | Browstein | 164/87 |
| 3,795,269 | 3/1974 | Leconte et al. | 164/268 |

*Primary Examiner*—Robert L. Spicer, Jr.
*Attorney, Agent, or Firm*—Herbert M. Hanegan; Stanley L. Tate; Robert S. Linne

[57] ABSTRACT

A method of and apparatus for continuously casting molten metal are disclosed wherein a flexible belt is used to enclose the peripheral groove of the casting wheel of a wheel-belt type machine and the useful life of the belt as well as the heat-transfer rate of the molten metal are increased by providing a continuous length of ablative material on the surface of said flexible belt which contacts the molten metal.

5 Claims, 5 Drawing Figures

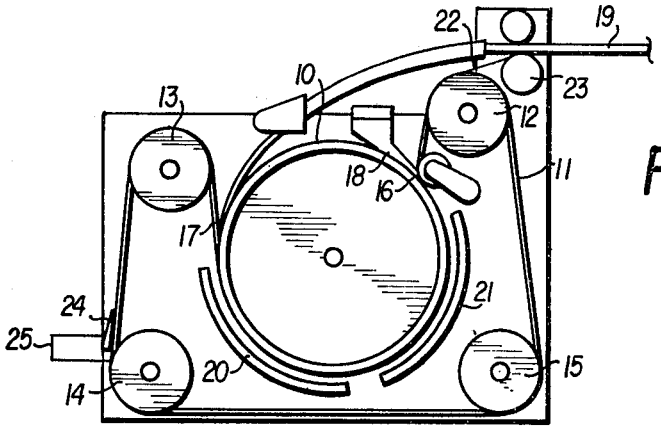
FIG. 1
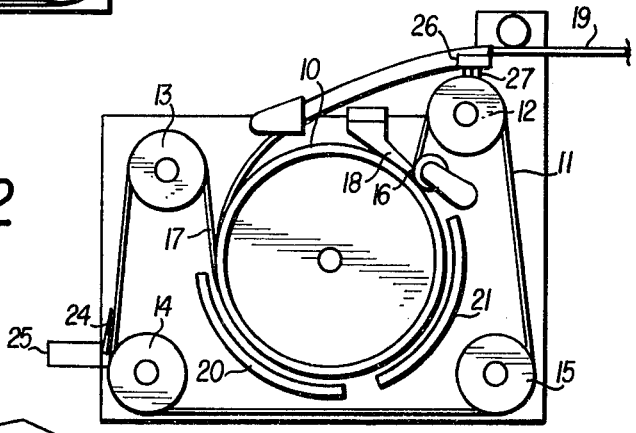
FIG. 2
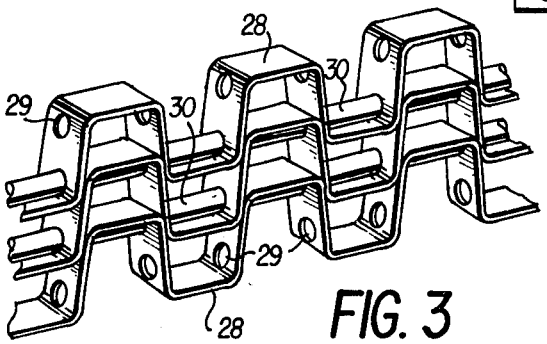
FIG. 3
FIG. 4
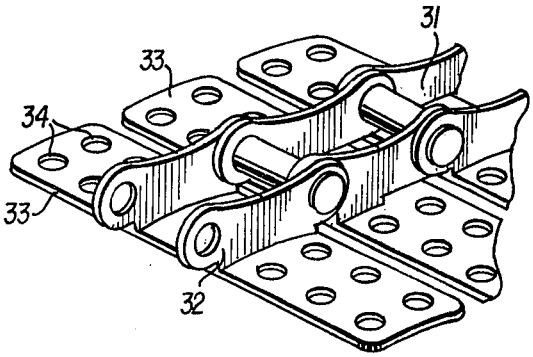
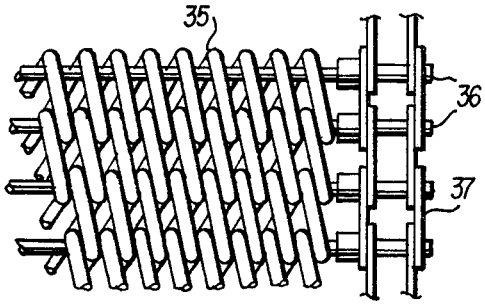
FIG. 5

ABLATIVE BAND FOR A CASTING MACHINE

BACKGROUND OF THE INVENTION

This invention relates generally to metal founding, and more particularly to an improved method of and apparatus for casting molten metal in a continuous casting machine of the wheel-belt type.

In known continuous casting systems, molten metal is flowed into a mold formed by enclosing an arcuate portion of the peripheral groove of a rotating casting wheel with a flexible endless metal belt. As the casting wheel rotates, a coolant is applied to the external surfaces of the wheel adjacent the peripheral groove and to the flexible belt to prevent excessive heating thereof and to achieve rapid solidification of the molten metal. As the cast metal travels between the rotating casting wheel and the circumferential belt, it solidifies and emerges from between the two surfaces as a continuous bar, ready to be rolled or otherwise worked. For the purposes of illustration, the present invention will be described with specific reference to its use in a continuous copper bar or a continuous aluminum bar casting operation such as just mentioned, but it is to be understood that the invention in its broader aspects may be utilized with other metals and other continuous casting processes that employ moveable casting surfaces.

When continuously casting metals in machines of the above described type, it is highly advantageous to solidify the molten metal in as short a period of time as possible in order to maintain a high casting rate. Moreover, when casting metals containing alloying elements, rapid solidification is desired in order to maintain intermetallic compounds in solid solution and to limit the size of the particles that precipitate out of solution. However, the low cooling efficiency and non-uniformity of heat transfer inherent in the thick metal belts (0.060 inches or greater) of prior art casting machines preclude attainment of the high casting rates and metallurgical effects desired. This is especially so if the belt is fabricated of a material having a relatively low rate of heat transfer even though coolant is applied to the external belt surface in maximum practical pressure and volume.

It should be apparent, therefore, that to improve the casting rate of continuous casting machines of the type described concommitantly with the life expectancy of the flexible belt element, belts so formed must have a high heat transfer rate to achieve such improvements. However, the prior art recognizes several problems in attempting to fabricate the belt from thin gauge and/or high heat transfer materials. Notably, one problem encountered when fabricating mold components of high heat transfer rate materials is the typically low structural strength of such materials which adversely affects their useful life, as explained in U.S. Pat. No. 3,464,483. While reducing belt thickness would tend to reduce belt strain exerted by the belt wheels on a belt formed of a high heat transfer rate material, the structural strength of the belt would, of course, be further diminished so that little advantage in terms of belt life could be realized.

A further problem associated with the use of thin gauge belt elements for continuous casting machines is explained in U.S. Pat. No. 3,533,463, wherein the patentees recognize the susceptibility of damage to a thin gauge belt, particularly at the edges thereof, when it is adequately tensioned to prevent leakage of molten metal from between the belt and casting wheel groove.

It is further noted in the aforesaid patent that the belt wheel flanges used to steer the belt into position for enclosing the groove are especially damaging to the edges of a thin gauge belt.

One prior art method and apparatus for improving belt life and casting rate is described in U.S. Pat. No. 3,642,055, wherein a foraminous wire mesh belt is employed to close the peripheral groove of the casting wheel of a wheel-belt type continuous casting machine. Coolant is directed through the openings in the belt to impinge directly upon the molten metal in the groove. The high surface tension of the molten metal is relied upon to prevent the molten metal from flowing through the openings in the foraminous belt. However, at the high casting rates contemplated by the present invention, the surface tension of the molten metal would very likely be insufficient to prevent leakage through the foraminous belt with the resultant danger of metal splatter in the area surrounding the casting machine. Even if leakage could be prevented, there always exists the possibility of obstructing the pores of the foraminous belt with solidified metal, rendering the escape of the vaporized coolant from the casting groove more difficult and thus increasing the danger of explosion. Moreover, the separation of the cast bar from the foraminous belt as the bar exits the casting groove could be hampered because of adherence between the cast bar and foraminous belt as the molten metal in contact with the belt solidifies. A further disadvantage of the apparatus and method described in U.S. Pat. No. 3,642,055 is the resulting poor quality of the cast bar which confronts the coarse and irregular surface of the foraminous belt.

SUMMARY OF THE INVENTION

The present invention overcomes the difficulty of short belt life encountered in prior art attempts to improve the casting rate of continuous casting machines by using belts formed of thin gauge materials having a high heat transfer rate.

In accordance with the present invention an ablative material is continuously provided onto the interior surface of the flexible belt which contacts the molten metal. The ablative material is employed as a mold element and molten metal is introduced into the mold formed by the groove of the casting wheel and the ablative material supported and held in place by the flexible belt. This ablative material forms a protective layer between the molten metal and the flexible belt. As the molten metal comes in contact with the ablative material the material is progressively charred or burned. Coolant is applied to the exterior surfaces of the belt and casting wheel groove to rapidly solidify the molten metal and form a solidified protective surface skin along the metal. As this solidified skin is being formed, the ablative material is progressively charred or burned due to the heat of the molten metal. With the use of an ablative material the flexible belt may be a very thin gauge, high heat transfer band or may be of foraminous construction, such as a porous belt, open grid construction belt, wire mesh belt or the like. It can readily be seen that higher heat transfer rates and thus casting rates can be achieved with the use of this invention since the high heat transfer thin belt or the porous type flexible belt allows for greater heat transfer from the molten metal or solidifying metal than would be possible using the relatively thick belt described in the prior art.

Therefore, it is an object of this invention to provide a continuous casting machine with a flexible belt having a high heat transfer rate and thus a high casting rate.

It is a further object of this invention to provide a continuous casting machine having an ablative material continuously supplied to the interior surface of the flexible belt, thereby providing for an increased heat transfer rate and increased casting rate.

A further object of the present invention is to provide a method of continuously casting molten metal at high production rates wherein an ablative material is provided to the interior surface of a flexible belt which closes the peripheral portion of a grooved casting wheel forming a mold for the molten metal and applying coolant to the exterior surface of the flexible belt, and where the flexible belt is foraminous or porous applying coolant to the ablative material through the flexible belt openings.

With these and other objects, advantages and features of the invention that may become hereinafter apparent, the nature of the invention may be more clearly understood by reference to the following detailed description of the invention, the appended claims and the attached drawings.

BRIEF DESCRIPTION OF THE DRAWINGS

FIG. 1 is a schematic elevation view of one embodiment of a wheel-belt continuous casting machine in accordance with the present invention wherein a continuous strip of ablative material is supplied to the flexible belt from a dispenser immediately prior to introduction of molten metal to the mold.

FIG. 2 is a schematic elevation view of another embodiment of a wheel-belt continuous casting machine according to the present invention wherein the ablative material is sprayed onto the casting belt immediately prior to the introduction of molten metal to the mold.

FIG. 3 is a fragmentary perspective view of one embodiment of flexible belt construction suitable for use in the present invention.

FIG. 4 is a fragmentary perspective view of one embodiment of flexible belt construction suitable for use in the present invention.

FIG. 5 is a fragmentary perspective view of one embodiment of flexible belt construction suitable for use in the present invention.

DESCRIPTION OF THE PREFERRED EMBODIMENTS

For purposes of illustration, the invention herein will be described as embodied in continuous casting apparatus and procedures of generally conventional types, for effecting the continuous casting of copper, aluminum, steel and their alloys in bar and rod forms. It should be understood that the invention described herein is used in conjunction with a reservoir of conventional type which is not shown for the sake of clarity.

Referring now in detail to the drawings wherein like parts are designated by like reference numerals throughout, there is illustrated in FIG. 1 a wheel-belt type continuous casting machine comprising a rotatably mounted casting wheel 10 and an endless belt 11 mounted for continuous movement around belt support wheels 12, 13, 14 and 15. The belt 11 and the casting wheel 10 are mutually disposed and arranged so that along a portion of their respective paths the belt 11 contacts the casting wheel by moving through a peripheral groove inscribed upon the surface of the casting wheel so as to define between them a casting mold having a mold inlet 16 and a mold outlet 17.

Molten metal is supplied from a pour spout 18 to the mold inlet 16 of the casting mold. As the metal moves through the casting mold it solidifies into a continuous bar 19 which emerges from the mold outlet 17. To promote solidification, coolant means 20 and 21 are provided which impinge liquid coolant against the surface of the belt. Other cooling means (not shown) are arranged to supply coolant to the external peripheral groove surfaces. An arrangement of a belt cooling system which may be adapted to supply coolant to the wheel and belt of the present invention is more fully described in U.S. Pat. No. 3,596,702, which disclosure is incorporated herein by reference.

In accordance with the embodiment of this invention depicted in FIG. 1, the casting surface of belt 11, the surface which faces the casting wheel and traverses the casting mold, is supplied with ablative material 22 from dispenser 23. The ablative material is supplied to the casting surface of belt 11 in synchronism thereto, i.e., without any relative movement with respect to moving flexible belt 11. Scraper 24 removes any residue of ablative material 22 remaining on belt 11 after bar 19 exits the casting mold. Receptacle 25 receives any ablative material 22 scraped from belt 11 by scraper 24.

FIG. 2 illustrates another embodiment of this invention wherein the ablative material is sprayed onto belt 11 from reservoir 26 through nozzles 27.

FIGS. 3, 4 and 5 illustrate alternative embodiments of the flexible belt for use in the present invention. FIG. 3 illustrates a portion of an open-grid support belt formed of a plurality of shaped flat wire sections 28 having openings 29 therethrough. The sections 28 are interconnected by rods 30 extending alternately through the openings 29 of a pair of adjacently disposed flat-wire sections 28.

FIG. 4 comprises a chain-like member 31 formed of links 32, and having attached transversely thereof at each link 32 a perforated plate 33 which may have a slightly curved surface as shown so as to conform to the radius of curvature of the casting wheel with which it is employed. Coolant is applied to the ablative material through apertures 34 suitably arranged in the plates 33.

FIG. 5 illustrates a portion of a double weave wire mesh 35 reinfored with rods 36 for added strength. At the edges thereof (only one shown) is arranged an optional roller chain 37 for engagement with a sprocket wheel which may be provided at the ends of the guide wheels of the casting machines of the previously described embodiments.

In view of the foregoing, it should be apparent that there is provided by the present invention a novel wheel-belt type continuous casting machine which includes a flexible belt having supplied thereto an ablative material so that heat transfer from molten metal is increased thereby making possible higher casting rates. In the operation of the present invention the ablative material may be of various substances or materials. It may be metallic or non-metallic provided it will char, vaporize or the like during the period of time it is in contact with the molten or partially solidified metal and assist in increasing heat transfer rates. A plastic or resin, low temperature metals such as aluminum, aluminum alloys, steel, tin alloys and copper alloys may be used. Advantageously substances such as paper, paper-mache, asbestos, plastics, phenolic resins, epoxy resins, silica fibers, glass fibers, low temperature metals and mixtures thereof are used. The preferred ablative material may vary when casting different molten metals, however for the material to be satisfactory it must at least partially char, vaporize or the like during the length of time it is in contact with the molten or partially solidified metal in the mold. The ablative material such as paper, glass fibers, asbestos, low temperature metals, and the like may be applied to the flexible belt of the casting machine as a continuous strip from a dispenser. Ablative materials that are liquid or susceptible to being solutionized such as plastics, phenolic or epoxy resins and the like may be sprayed onto the flexible belt through nozzles from a reservoir either located on the casting machine or at some distance from the csting machine, the reservoir being connected to the nozzles by hoses and the like. Advantageously, the ablative material as provided on the flexible belt has a thickness of from about 1/64 to ¼ inch. The thickness of the material will vary depending upon the temperature of the molten metal being cast and the composition of the ablative material.

When casting some molten metals or molten metal alloys it is advantageous to apply to the ablative material an additional material selected from the group consisting of zirconium, titanium oxide, graphite, charrable petroleum products, aluminum powder, iron powder and mixtures thereof. Where at least a portion of the ablative material is desired to be a non-metallic, heat resistant material it is advantageous to use asbestos paper. Where it is desirable that at least a portion of the ablative material leave substantially no ash upon burning it is advantageous to use ashless paper as a component of the ablative material.

The cooling rate of the metal can be influenced or controlled by modifying the physical or chemical characteristics of the ablative material. Where the ablative material is paper or the like it may be additionally treated with a wash such as a metal or chemical wash, thereby providing a more suitable mold film, molten metal skin or coating or rate of formation thereof.

If a non-porous flexible belt is used with this invention it is advantageous that the belt have a thickness of less than 0.06 inches. Where the belt is of a porous construction it may be of any suitable porous configuration. Advantageously, the flexible porous belt is formed with an open grid construction, a chain-like construction having links with perforated plates attached transversely to each link, or formed at least partially of wire mesh. A higher rate of cooling may be effected using a flexible belt having a porous construction and applying coolant to the ablative material through said flexible belt.

The invention has been described in conjunction with one particular embodiment and it is to be understood that obvious modifications and changes may be made without departing from the spirit and scope of the invention as defined in the appended claims and the invention is intended to cover all such modifications and changes which fall within the scope of the claimed invention.

I claim:

1. In a method of continuously casting molten metal by the substantially complete solidification of the metal in an arcuate mold defined by a groove in the periphery of a rotating casting wheel which is closed over a portion of its length by a movable endless flexible belt, including pouring the molten metal into the mold, applying a liquid coolang against the surfaces of the belt and the wheel to cool the metal in the mold and substantially completely solidify the metal into a cast bar and extracting the cast from the mold;

the improvement comprising increasing the heat-transfer rate from the molten metal in the mold by providing a belt comprising a foraminous member having transverse openings extending therethrough, continuously applying an ablative material between said foraminous member and the molten metal, permitting the molten metal to char the ablative material as it comes in contact therewith, and applying a coolant through the openings in said member directly against the ablative material, said charring of the ablative material effecting a transfer of heat from the molten metal which together with the application of the coolant through the openings in said member results in the rapid formation of a solidified surface skin on the metal adjacent the inner surface of the member.

2. The method of claim 1, wherein said foraminous member is formed with an open-grid construction.

3. The method of claim 1, wherein said foraminous member is at least partially formed of wire mesh.

4. In apparatus for the continuous casting of molten metal including a wheel-belt type continuous casting machine having a mold defined by an arcuate groove formed in the periphery of a rotatable casting wheel that is closed over a portion of its length by an endless flexible metal belt, means for introducing molten metal into said mold, coolant means for cooling the metal in said mold to form a cast bar, and means for extracting the cast bar from said mold;

the improvement comprising means for continuously supplying an ablative material between said belt and the molten metal in said mold, said ablative material being adapted to become charred upon contact with the molten metal thereby extracting heat therefrom and together with the application of said coolant effecting the formation of a solidified surface skin on the metal adjacent the inner surface of said belt, said belt comprising a foraminous member having transverse openings extending therethrough, said coolant means comprising arcuate spray headers adapted to spray liquid coolant through said openings in said foraminous member directly against said ablative material for increasing the rate of heat transfer from the molten metal in said mold, said foraminous member comprising a plurality of spaced flat straps bent into alternate U-shaped segments, said straps having openings through which connecting rods extend.

5. In apparatus for the continuous casting of molten metal including a wheel-belt type continuous casting machine having a mold defined by an arcuate groove formed in the periphery of a rotatable casting wheel that is closed over a portion of its length by an endless flexible metal belt, means for introducing molten metal into said mold, coolant means for cooling the metal in said mold to form a cast bar, and means for extracting the cast bar from said mold;

the improvement comprising means for continuously supplying an ablative material between said belt and the molten metal in said mold, said ablative material being adapted to become charred upon contact with the molten metal thereby extracting heat therefrom and together with the application of said coolant effecting the formation of a solidified surface skin on the metal adjacent the inner surface of said belt, said belt comprising a foraminous member having transverse openings extending therethrough, said coolant means comprising arcuate spray headers adapted to spray liquid coolant through said openings in said foraminous member directly against said ablative material for increasing the rate of heat transfer from the molten metal in said mold, said foraminous member comprising a plurality of chain-link segments carrying flat plates having openings extending therethrough.

* * * * *